US006321729B1

(12) United States Patent
Chien

(10) Patent No.: US 6,321,729 B1
(45) Date of Patent: Nov. 27, 2001

(54) METHOD FOR IMPROVING FUEL AND DEVICE FOR IMPROVING FUEL

(76) Inventor: Cheng Hsong Chien, 3 Floor, No.65-7, Chi-Chin Third Rd., An-Le Dist., Chi-Long City (TW)

( * ) Notice: Subject to any disclaimer, the term of this patent is extended or adjusted under 35 U.S.C. 154(b) by 0 days.

(21) Appl. No.: 09/677,512

(22) Filed: Sep. 29, 2000

(51) Int. Cl.[7] ..... F02M 33/00
(52) U.S. Cl. ..... 123/536; 123/538
(58) Field of Search ..... 123/536, 537, 123/538, 539

(56) References Cited

U.S. PATENT DOCUMENTS 5,044,346 * 9/1991 Tada et al. ..... 123/536
5,460,144 * 10/1995 Park et al. ..... 123/538
5,632,254 * 5/1997 Kim ..... 123/538

* cited by examiner

*Primary Examiner*—Marguerite McMahon
(74) *Attorney, Agent, or Firm*—Charles E. Baxley

(57) ABSTRACT

A fuel improving device for an engine includes a plurality of casings with a tube extending through the respective passages defined through the casings. Two ends of the tube are respectively connected to fuel hose and an engine fuel pipe. A plurality of magnetic members and far infra-red material are respectively connected to an inner periphery of the passages of the casings. A method for improving fuel into the engine is to let the fuel and air pass by the magnetic members and far infra-red material so that the particles of fuel and air are reassembled and minimized.

3 Claims, 7 Drawing Sheets

METHOD FOR IMPROVING FUEL AND DEVICE FOR IMPROVING FUEL

FIELD OF THE INVENTION

The present invention relates to a method for minimizing particles of fuel and a device for improving fuel. The device includes far infra-red material and magnetic members connected to an outside of fuel pipes and the particles of fuel will be minimized so as to increase performance of engines.

BACKGROUND OF THE INVENTION

A conventional gasoline engine is a four cycle operation mechanism which receives gasoline-air mixture in the chamber of the engine, compresses the mixture, ignite the mixture by a spark from a spark plug, and open a valve to left the exhaust flow from the chamber. There are many factors which affect the performance of an engine, one of which is the size of particles of gasoline. The smaller the particles are, the better performance the engine will have. However, the size of a fuel ejection nozzle is fixed and generally the nozzle size cannot be adjusted so that the user cannot do anything at this end section. Some fuel improving devices are developed which employ magnetic members to affect the particles of fuel. The fuel particles are re-arranged because of the magnetic force so that the size of particles of fuel can be reduced. Nevertheless, to use magnetic members to re-assemble the particles of fuel is difficult to be proceeded because the magnetic force is required to be large enough such that it can affect the connection between particles of fuel, Of more importance is that the magnetic force will surely affect the electronic control system of the vehicles.

The presence invention intends to provide a fuel improving device which employs far infra-red material to activate the particles of fuel and magnetic members to minimize the size of the particles of fuel.

SUMMARY OF THE INVENTION

In accordance with one aspect of the present invention, there is provided a fuel improving device for an engine and comprising a plurality of casings and a tube extending through passages defined through the casings. The tube are connected between a fuel hose and an engine fuel pipe. A plurality of magnetic members are connected to an inner periphery of the passages of the casings, and far infra-red material is connected between the tube and the casings. The particles of the fuel and the air will be reassembled and minimized under the affection of the magnetic force from the magnetic members and the far infra-red beams from the far infra-red material.

The primary object of the present invention is to provide a fuel improving device that employs magnetic members and far infra-red material to treat the fuel and air in the casings of the device so that the fuel will be reassembled to be a smaller particles which are benefit for combustion in the engine.

Another object of the present invention is to provide a method for improving fuel before entering into engine. The method employs magnetic force and far infra-red beam to let the particles of the fuel and the air be reassembled and minimized.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
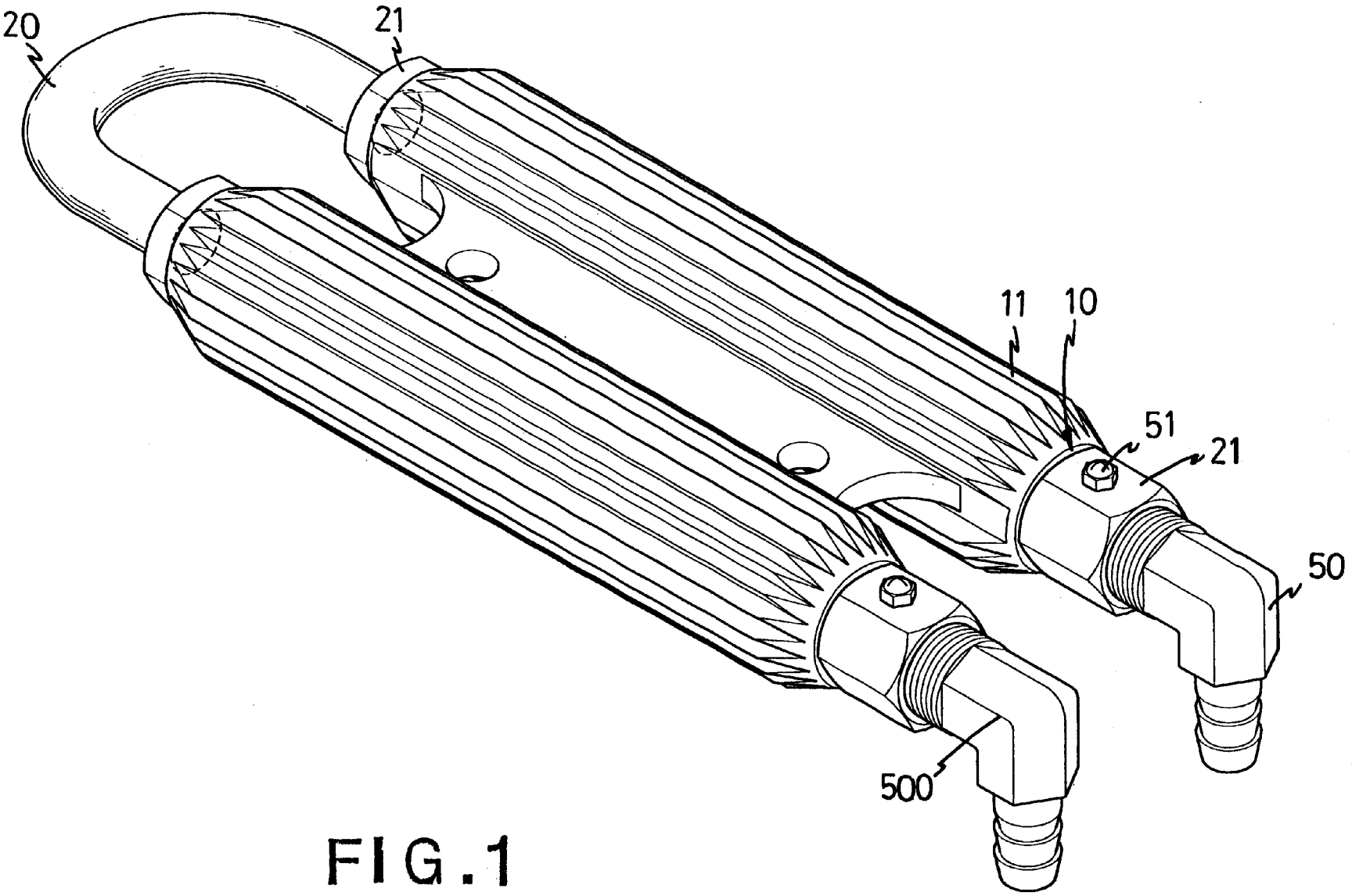
FIG. 1 is a perspective view to a show a fuel improving device of the present invention.
Figure 2:
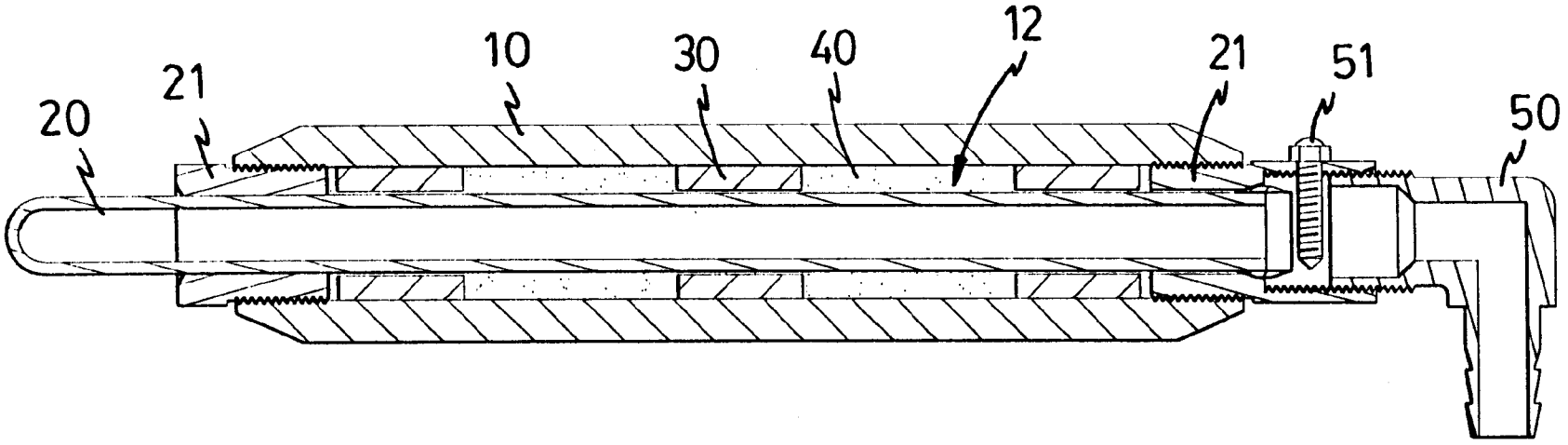
FIG. 2 is a cross sectional view to show the device of the present invention.
Figure 3:
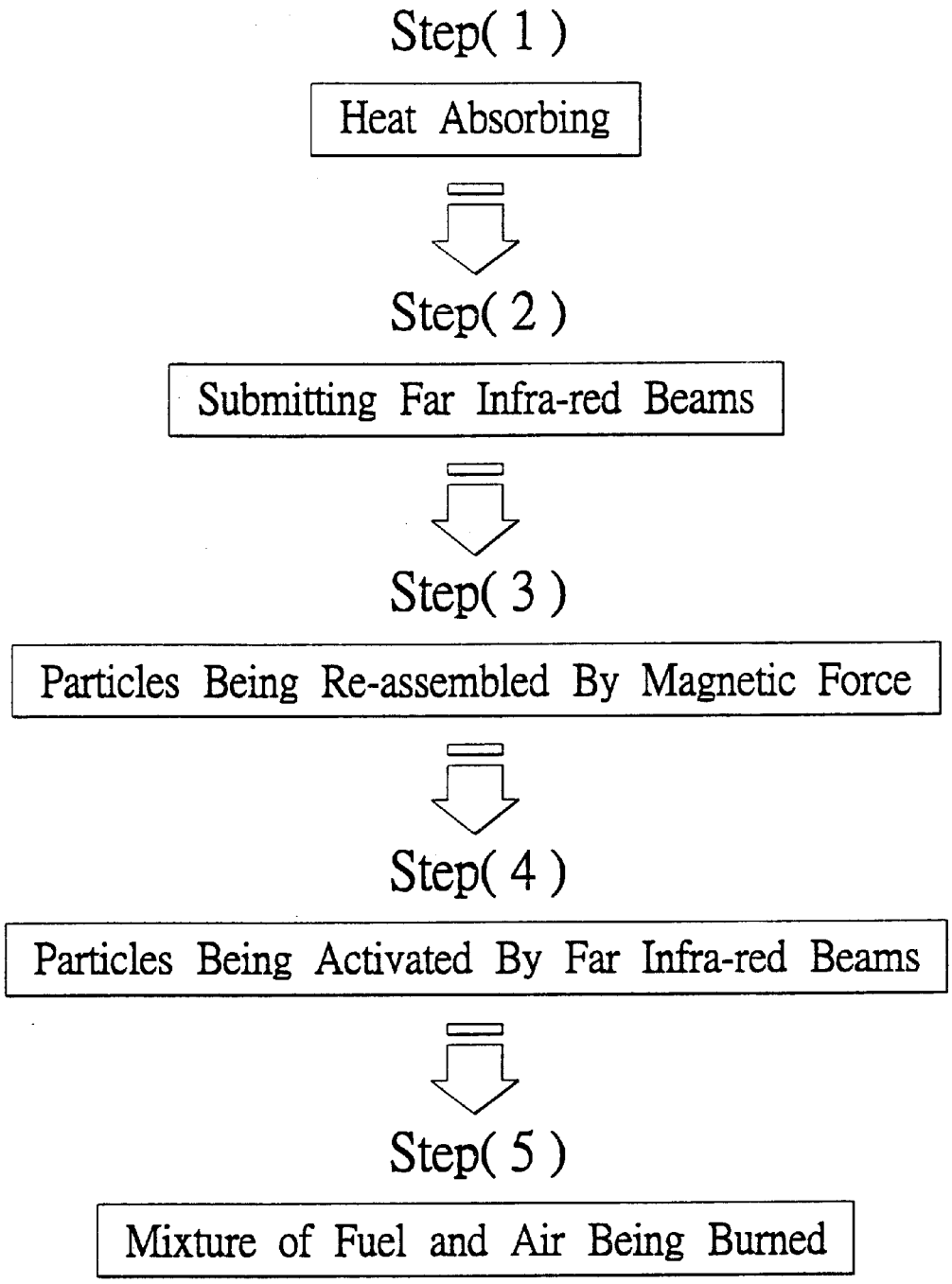
FIG. 3 is a flow chart to show a method for improving the fuel of the present invention.
Figure 4:
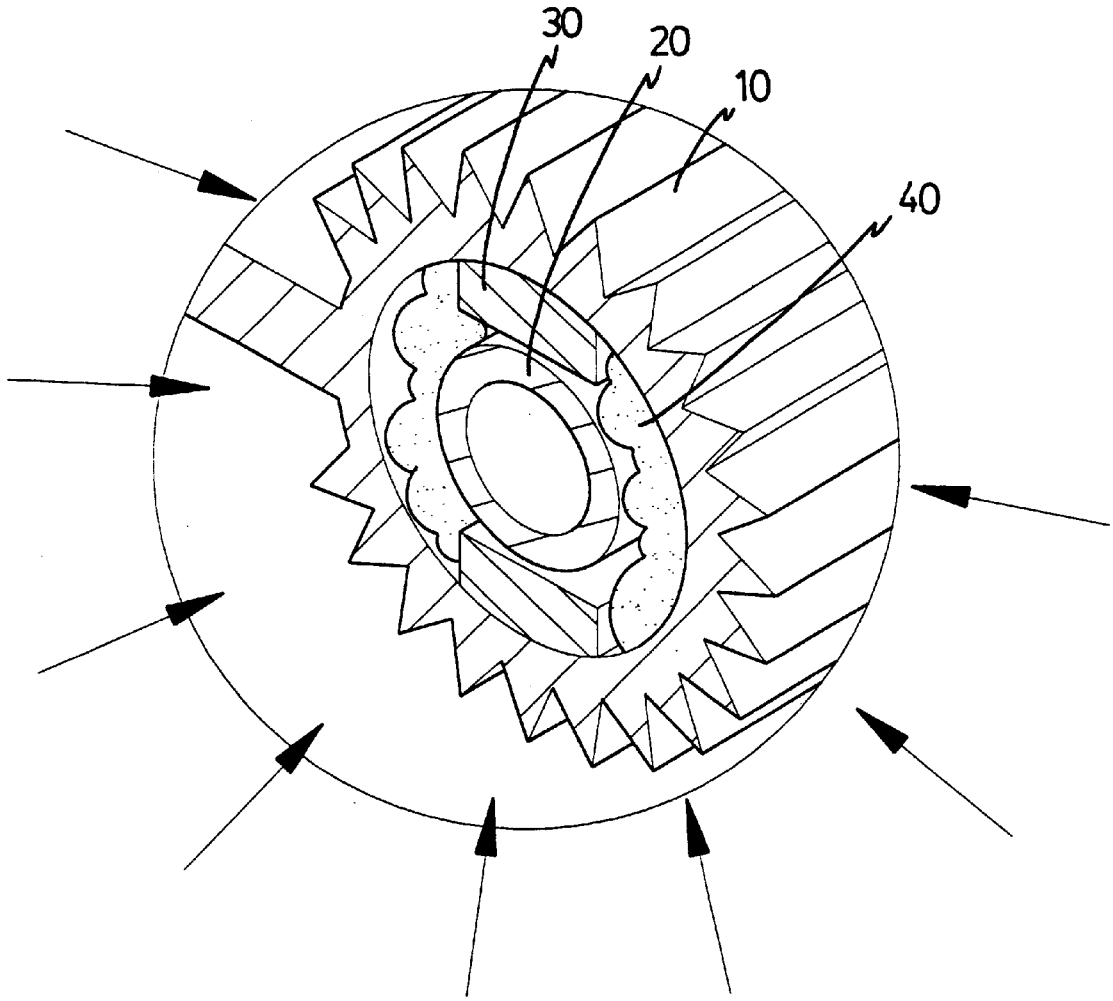
FIG. 4 is a cross sectional view to show a casing of the device of the present invention.

Referring to FIGS. 1, 2, 4 and 5, the fuel improving device of the present invention comprises a plurality of tubular casings 10 and each casing 10 has a passage 12 defined therethrough. A plurality of fins 11 extend radially outward from the casings 10 so as to increase area to absorb heat from the engine. A U-shaped tube 20 extends through the passages 12 of the casings 10 as shown in FIG. 1 and a separation member 21 is connected between the tube 20 and two ends of the inner periphery of the passages 12 so as to position the tube 20 at a central portion of the casings 10. One end of the tube 20 is connected to a first fitting 50 and the other end of the tube 20 connected to a second fitting 500. The first fitting 50 is connected to an engine fuel pipe which is directly connected to the engine and the second fitting 500 is connected to a fuel hose which is connected to a fuel tank. An adjusting bolt 51 is movably connected to each of the first fitting 50 and the second fitting 500, and a gap is defined between a tip of the adjusting bolt 51 and an inner periphery of each of the first fitting 50 and the second fitting 500. Therefore, the volume of the fuel to be entered into the engine can be adjusted by rotating the adjusting bolt 51.

A plurality of magnetic members 30 are connected to an inner periphery of the passages 12 of the casings 10, and a plurality of far infra-red material 40 are connected between the tube 20 and the casings 10 wherein the far infra-red material 40 can be coated to the inner periphery of the passages 12.

Figure 5:
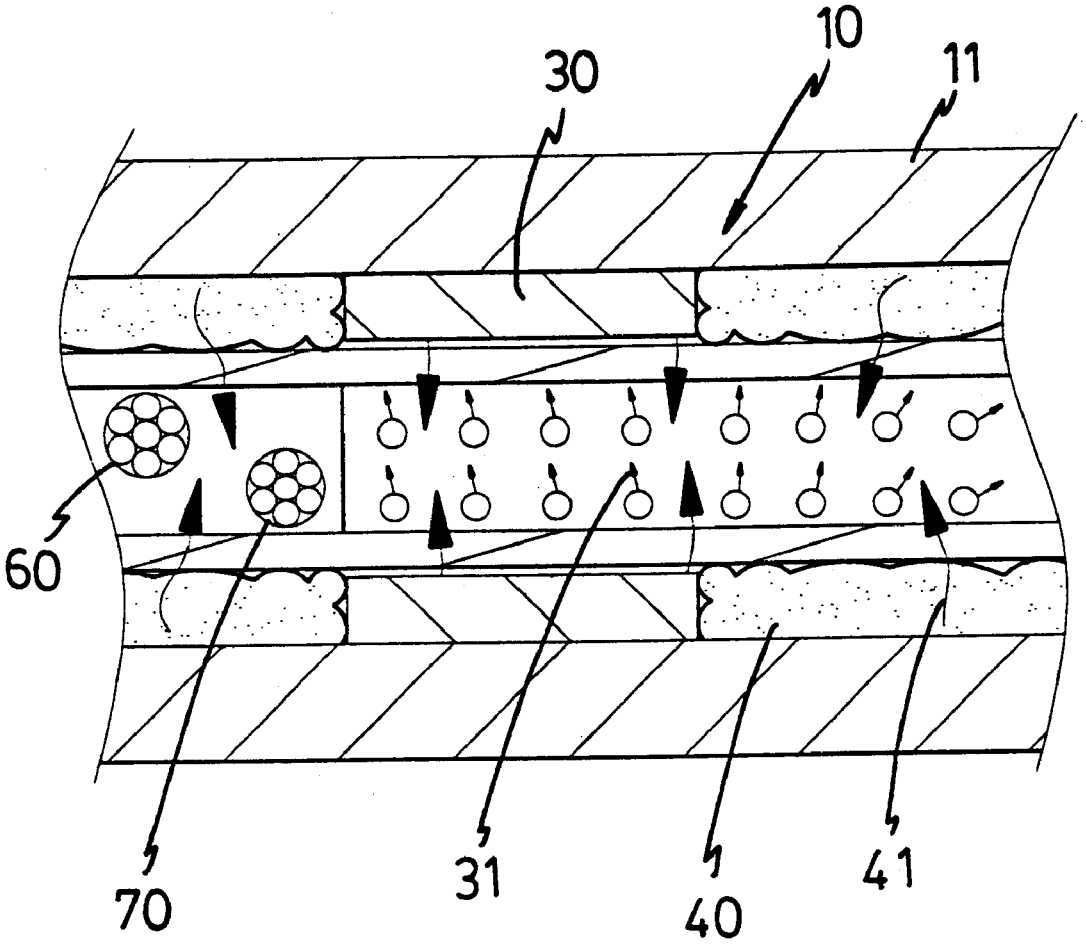
FIG. 5 is a cross sectional view to show the particles of fuel and air are treated in the casing of the device of the present invention.

As shown in FIG. 5, when the fuel 60 and the air 70 enter the casings 10, the magnetic force 31 breaks the connections between the particles of the fuel 60 and the air 70. The far infra-red material 40 absorb heat from the fin 11 and send far infra-red beams 41 to the particles of the fuel 60 and the air 70. A distance between the particles of the fuel 60 and the air 70 is enlarged because they are activated by the far infra-red beams 41. Therefore, the viscosity and the volume of the particles of the fuel 60 and the air 70 are minimized, and the combustion in the engine is improved.

Figure 6:
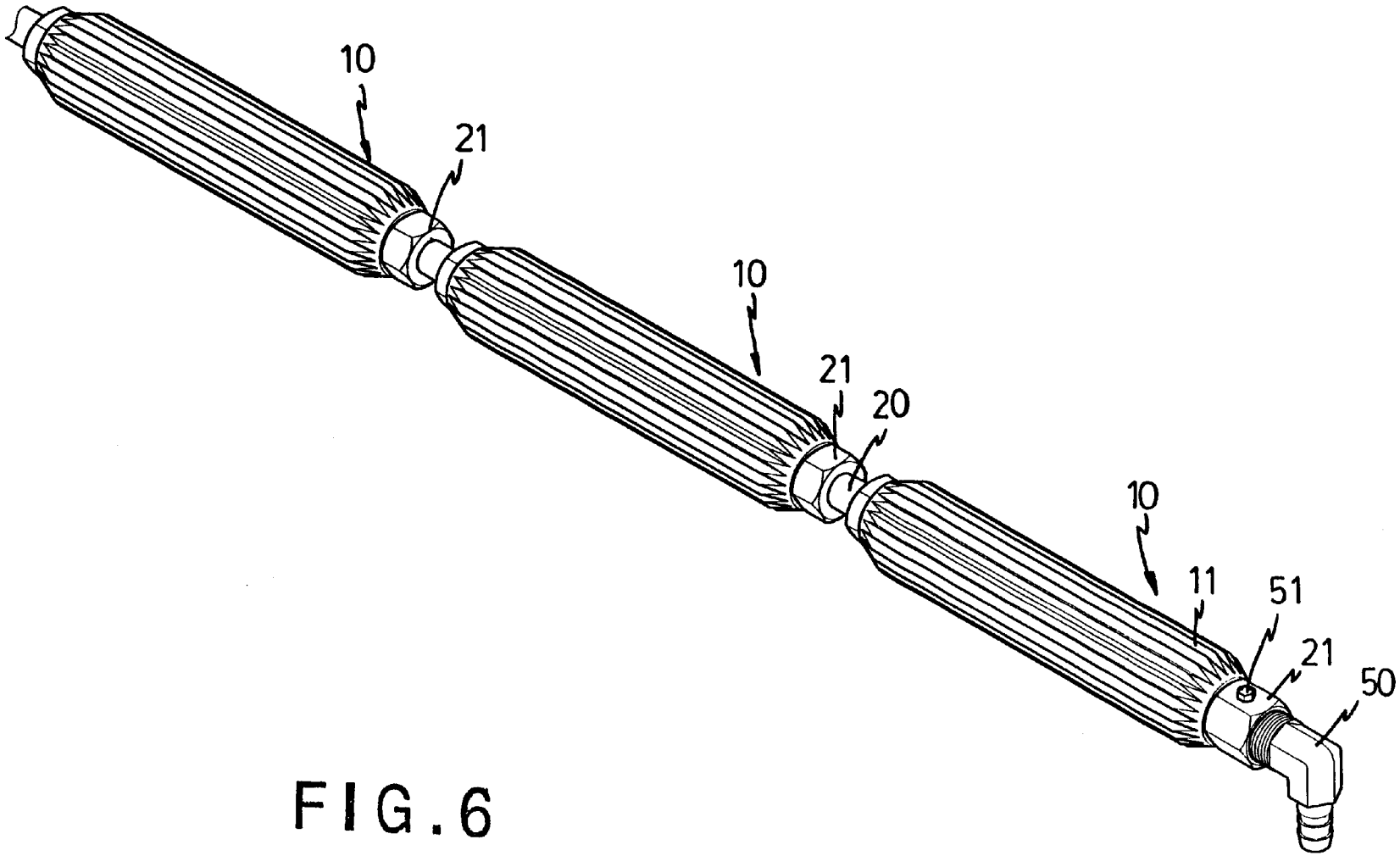
FIG. 6 is a perspective view of show another embodiment of the fuel improving device of the present invention.
Figure 7:
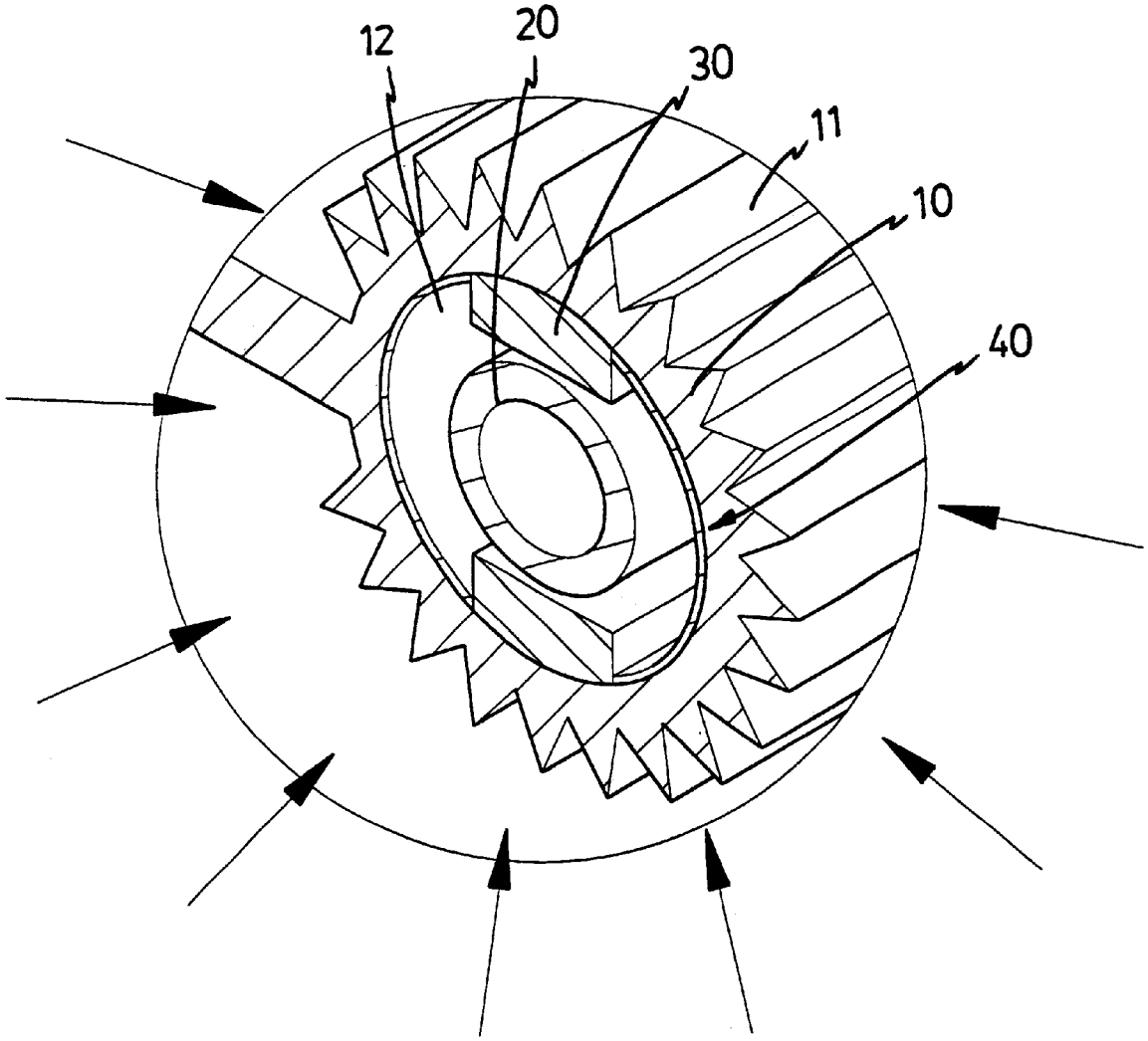
FIG. 7 is a cross sectional view to shown another embodiment of the position of the magnetic members and the far infra-red material in the casing of the device of the present invention.

FIG. 6 shows another embodiment of the device of the present invention wherein three casings 10 are connected successively by a tube 20 so that the fuel and the air can be completely proceeded under magnetic force and the far infra-red beams 41. FIG. 7 shows that the far infra-red material 40 can be coated to the inner periphery of the passages 12 and the magnetic members 30 extend radially inward from the inner periphery of the passages 12. By this device of the present invention, the particles of the fuel and the air before entering the engine is well minimized and mixed so that the fuel can be completely burned.

A method for improving fuel used in the device comprises the following steps:

step (1): employing far infra-red material 40 to absorb heat from engine;

step (2): submitting far infra-red beams 41 to fuel after the far infra-red material absorbed heat from the fins on the casings 10;

step (3): employing magnetic members 30 to separate the particles of the fuel and the air so as to reassemble these particles of the fuel and the air;

step (4): the particles of fuel and particles of air being actuated by the far infra-red beams 41 and a distance between particles of the fuel and the air being enlarged, and step (5): a mixture of fuel and air being burned.

The method can be proceeded by using the device described above. The procedures in step (2) and step (3are able to be proceeded at the same time.

While we have shown and described various embodiments in accordance with the present invention, it should be clear to those skilled in the art that further embodiments may be made without departing from the scope and spirit of the present invention.

What is claimed is:

1. A fuel improving device for an engine, comprising:

a plurality of casings each having a passage defined therethrough and a plurality of fins extending outward from each of said casings:

a tube extending through said passages of said casings, one end of said tube connected to a first fitting and the other end of said tube connected to a second fitting, said first fitting adapted to be connected to an engine fuel pipe;

a plurality of magnetic members connected to an inner periphery of said passages of said casings; and far infra-red material connected between said tube and said casings.

2. The device as claimed in claim 1 further comprising an adjusting bolt movably connected to each of said first fitting and said second fitting, a gap defined between a tip of said adjusting bolt and an inner periphery of each of said first fitting and said second fitting.

3. The device as claimed in claim 1 further comprising a separation member connected between said tube and said inner periphery of said passages.

* * * * *